US007322125B2

(12) United States Patent
Byun et al.

(10) Patent No.: US 7,322,125 B2
(45) Date of Patent: Jan. 29, 2008

(54) DRY HEATER FIXING UNIT OF DRUM-TYPE WASHING MACHINE COMBINED WITH DRIER

(75) Inventors: Sang Tae Byun, Daegu (KR); Jae Mun Kim, Jinhae-si (KR)

(73) Assignee: LG Electronics Inc., Seoul (KR)

( * ) Notice: Subject to any disclaimer, the term of this patent is extended or adjusted under 35 U.S.C. 154(b) by 0 days.

(21) Appl. No.: 11/034,794

(22) Filed: Jan. 14, 2005

(65) Prior Publication Data

US 2005/0223586 A1 Oct. 13, 2005

(30) Foreign Application Priority Data

Apr. 12, 2004 (KR) ..... 10-2004-0024937
Apr. 12, 2004 (KR) ..... 2004-24936

(51) Int. Cl.
*F26B 21/06* (2006.01)

(52) U.S. Cl. ..... 34/546; 34/607

(58) Field of Classification Search ..... 34/600–607; 219/546, 550

See application file for complete search history.

(56) References Cited

U.S. PATENT DOCUMENTS 3,790,751 A * 2/1974 Kuhn ..... 219/525
3,992,609 A * 11/1976 Alexander ..... 219/532
4,025,754 A * 5/1977 Marzonie et al. ..... 219/400
4,700,495 A * 10/1987 Drews et al. ..... 34/603
5,134,270 A * 7/1992 Bragg et al. ..... 219/532
6,002,116 A * 12/1999 St. Louis ..... 219/542
6,678,969 B1 * 1/2004 Hong ..... 34/595
2005/0217138 A1 10/2005 Kohne et al.
2006/0026859 A1 * 2/2006 Bang ..... 34/132

FOREIGN PATENT DOCUMENTS

EA 1 486 605 A1 12/2004
EP 1 538 255 A1 6/2005

* cited by examiner

*Primary Examiner*—S. Gravini
(74) *Attorney, Agent, or Firm*—Birch, Stewart, Kolasch & Birch, LLP

(57) ABSTRACT

A heater fixing unit of a drum-type washing machine is provided. The heater fixing unit more stably supports a heater installed in a dry duct to reduce vibration and a noise of the heater. For that purpose, the heater fixing unit includes a duct body, a heater, two or more fixing parts, and two or more clamp members. The duct body communicates with an inside of the drum. The heater is installed in an inside of the duct body to heat an air flowing in an inside of the duct body. The fixing parts protruded from two or more positions on an inner surface of the duct body. The clamp members fixedly support the heater.

18 Claims, 3 Drawing Sheets

DRY HEATER FIXING UNIT OF DRUM-TYPE WASHING MACHINE COMBINED WITH DRIER

This application claims the benefit of the Korean Application Nos. P2004-24936 and P2004-24937 both filed on Apr. 12, 2004, which are hereby incorporated by reference.

BACKGROUND OF THE INVENTION

1. Field of the Invention

The present invention relates to a drum-type washing machine combined with a drier, and more particularly, to a heater fixing unit of a drum-type washing machine combined with a drier, capable of stably fixing a heater that generates hot blast for drying in an inside of a dry duct.

1. Discussion of the Related Art

Generally, a drum-type washing machine is an apparatus for washing the laundry by rotating a drum using a driving force of a motor unit with detergent, washing water, and the laundry inserted into an inside of the drum. The drum-type washing machine has advantages that the laundry is less spoiled, the laundry is not tangled, and beating and rubbing washing effects can be achieved.

Recently, in addition to a washing cycle, a rising cycle and a dewatering cycle, which are essential functions of the drum-type washing machine, a drum-type washing machine combined with a drier capable of performing a drying cycle after completing the dewatering cycle is actively distributed.

The drum-type washing machine has a dry duct and a condensing duct for a drying cycle. The dry duct is fixed to an upper portion of a tub and the condensing duct is installed to a side portion or a rear portion of the tub. The dry duct and the condensing duct mutually communicate each other and so installed as to communicate with an inside of the drum to form a circulation passage of an air.

The dry duct has, in its inside, a heater and a ventilation fan for supplying hot blast in an inside of the drum. Thus, if the drying cycle starts, a power is applied to the heater and the heater generates heat. Simultaneously, the ventilation fan operates and an air floats into an inside of the dry duct. The floating air is heated by the heater and supplied to an inside of the drum.

The hot blast supplied to an inside of the drum heats the laundry to evaporate humidity of the laundry and flows into the condensing duct. The humid and hot blast that has flowed into the condensing duct is dried by condensed water and then flows again into the dry duct. The drum-type washing machine dries the laundry using a closed cycle of the hot blast.

However, the drum-type washing machine according to a related art has the following problems.

In case the dry duct is fixed to the tub as described above, vibration delivered to the dry duct is increased even more compared with a structure where the dry duct is fixed to a cabinet. So, in case the heater in an inside of the dry duct is not stably fixed to the dry duct, a portion that fixes the heater may be loosened by the vibration and a disorder may be generated at the heater or a big noise may be generated due to vibration of the heater.

SUMMARY OF THE INVENTION

Accordingly, the present invention is directed to a heater fixing unit of a drum-type washing machine that substantially obviates one or more problems due to limitations and disadvantages of the related art.

An object of the present invention is to provide a heater fixing unit of a drum-type washing machine capable of reducing a disorder of a heater or a noise generated due to vibration of a heater by more stably supporting the heater installed to a dry duct.

Additional advantages, objects, and features of the invention will be set forth in part in the description which follows and in part will become apparent to those having ordinary skill in the art upon examination of the following or may be learned from practice of the invention. The objectives and other advantages of the invention may be realized and attained by the structure particularly pointed out in the written description and claims hereof as well as the appended drawings.

To achieve these objects and other advantages and in accordance with the purpose of the invention, as embodied and broadly described herein, there is provided a heater fixing unit of a drum-type washing machine combined with a drier, including: a duct body whose one end communicates with an inside of a drum; a heater installed in an inside of the duct body, for heating an air floating in an inside of the duct body; at least two or more fixing parts protruded from at least two or more positions on an inner surface of the duct body; and at least two or more clamp members fixedly fastened to each fixing part of the duct body, for fixedly supporting the heater.

In another aspect of the present invention, a heater fixing unit of a drum-type washing machine combined with a drier, including: a duct body whose one end communicates with an inside of a drum; a heater installed in an inside of the duct body, for heating an air floating in an inside of the duct body; at least two or more fixing recesses concaved from at least two or more positions on an inner surface of the duct body; and at least two or more clamp members fixedly fastened to each fixing part of the duct body, for fixedly supporting the heater.

According to the present invention, since the heater is fixed in an inside of the duct body by at least two or more clamp members, the heater can be stably fixed even though vibration is delivered to the duct body attached to the tub.

It is to be understood that both the foregoing general description and the following detailed description of the present invention are exemplary and explanatory and are intended to provide further explanation of the invention as claimed.

BRIEF DESCRIPTION OF THE DRAWINGS

The accompanying drawings, which are included to provide a further understanding of the invention and are incorporated in and constitute a part of this application, illustrate embodiment(s) of the invention and together with the description serve to explain the principle of the invention. In the drawings.

DETAILED DESCRIPTION OF THE INVENTION

Reference will now be made in detail to the preferred embodiments of the present invention, examples of which are illustrated in the accompanying drawings.

Figure 1:
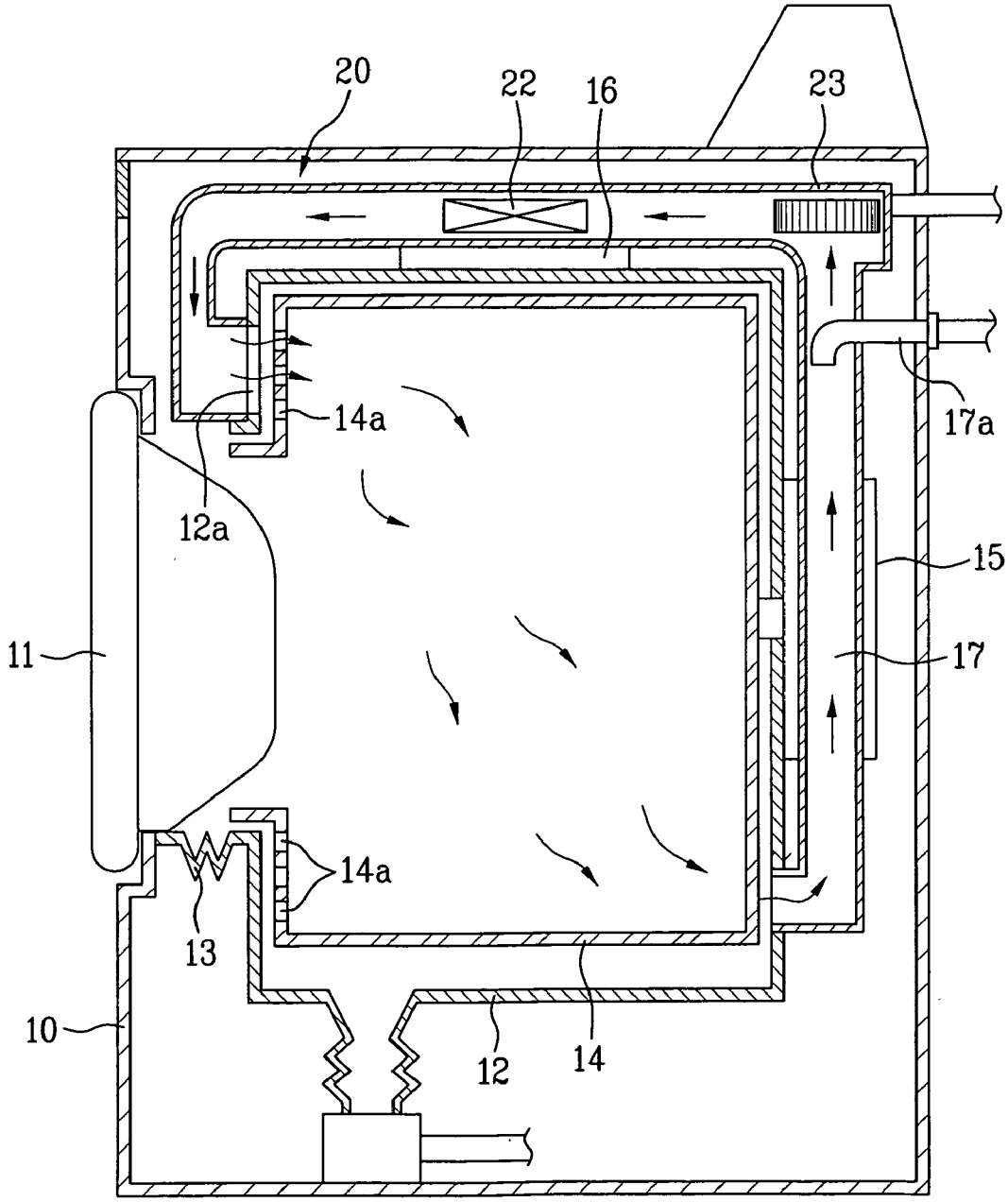
FIG. 1 is a view illustrating a construction of a drum-type washing machine combined with a drier according to the present invention.

Referring to FIG. 1, a heater fixing unit of a drum-type washing machine combined with a drier includes a cabinet 10, a door 11, a tub 12, a drum 14, a motor unit 15, a dry duct 20, and a condensing duct 17.

A laundry insertion hole is formed on a front side of the cabinet 10 and the door 11 is rotatably installed on one side of the laundry insertion hole to open/close the laundry insertion hole. The laundry insertion hole is connected with an opening of the tub 12 by a gasket 13 installed along an open edge of the tub 12. Accordingly, leakage of hot blast through the laundry insertion hole and a connection part of the tub and leakage of washing water to an outer side of the tub are prevented.

Though not illustrated in the drawing, the tub 12 is supported in its floating state by a damper and a suspension spring and stores the washing water.

The drum 14 is rotatably installed in an inside of the tub 12 and the motor unit 15 for delivering driving force to the drum 14 is installed in the tub 12. For the motor unit, an indirect driving type for rotating the drum by delivering driving force generated from the motor unit to a washing shaft through a belt may be applied, or a direct driving type for rotating the drum by directly delivering driving force generated from the motor unit to the washing shaft may be applied.

A heat-resistant plate 16 is fastened to an outer surface on an upper side of the tub 12 and the dry duct 20 is fixedly fastened to the heat-resistant plate 16. The heat-resistant plate 16 minimizes transfer of heat generated from a heater 22 to the tub 12.

In the meantime, a hot blast inlet 12*a* is formed on a front side of the tub 12 and one end of the dry duct 20 is connected with the hot blast inlet 12*a*. Further, a plurality of suction holes 14*a* are formed on a front edge of the drum 14 so that the hot blast that has passed through the hot blast inlet 12*a* may inflow into an inside of the drum 14. The suction hole 14*a* may be formed along the front edge of the drum 14.

In addition, a condensing duct 17 is communicatively connected with the tub 12 and the condensing duct 17 is communicatively connected with the dry duct 20. That is, a lower end of the condensing duct 17 is connected with a rear portion of the tub 12 and an upper end of the condensing duct 17 is connected with the dry duct 20. A water-supply unit 17*a* is connected with the condensing duct 17. The water-supply unit 17*a* supplies condensed water in an inside of the condensing duct 17 to dehumidify a humid air flowing from the tub 12. The air dehumidified in this manner flows into the dry duct 20.

Figure 2:
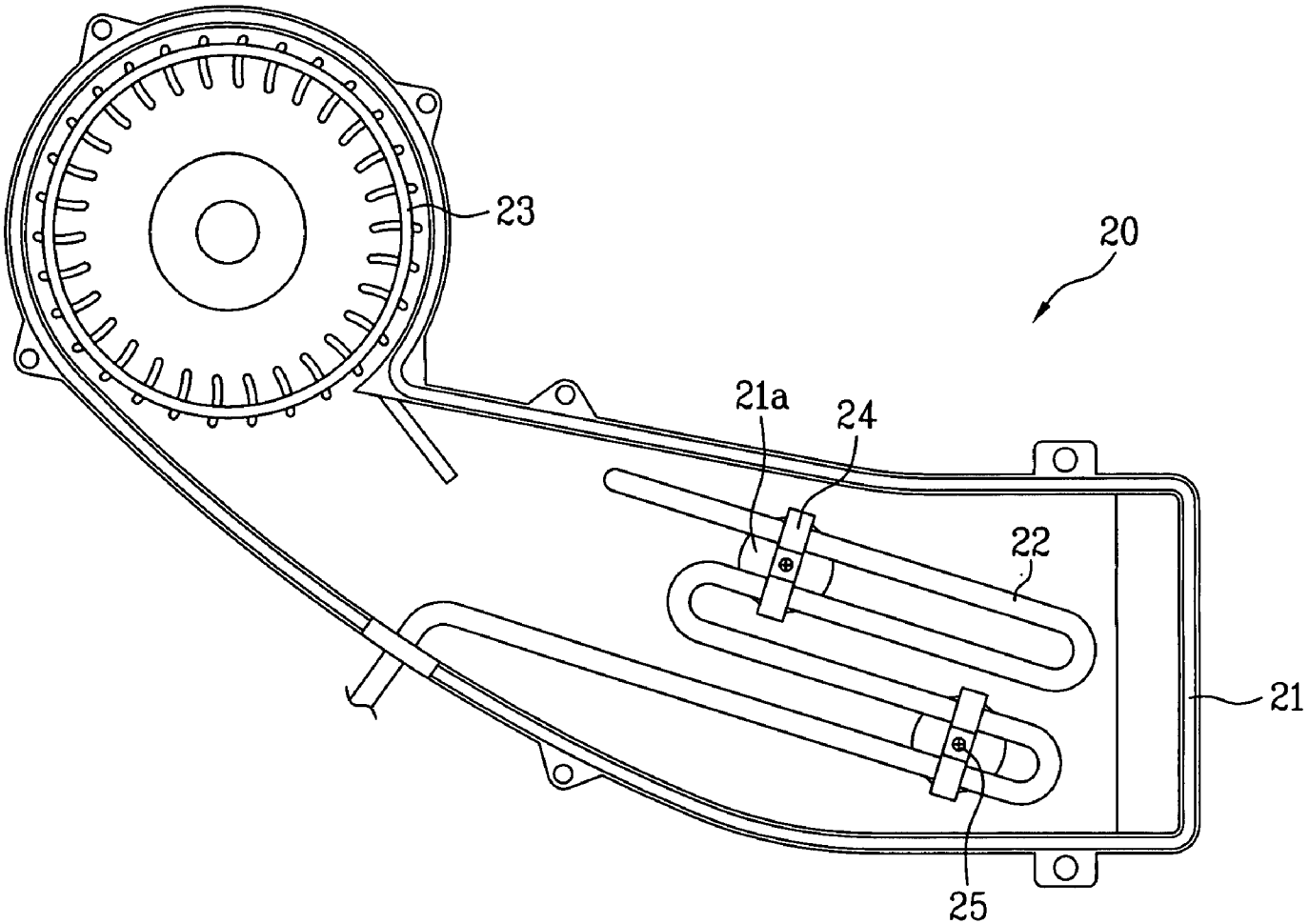
FIG. 2 is a plan view illustrating a dry duct and a heater fixing unit constituting the drum-type washing machine of FIG. 1 according to an embodiment of the present invention.
Figure 3:
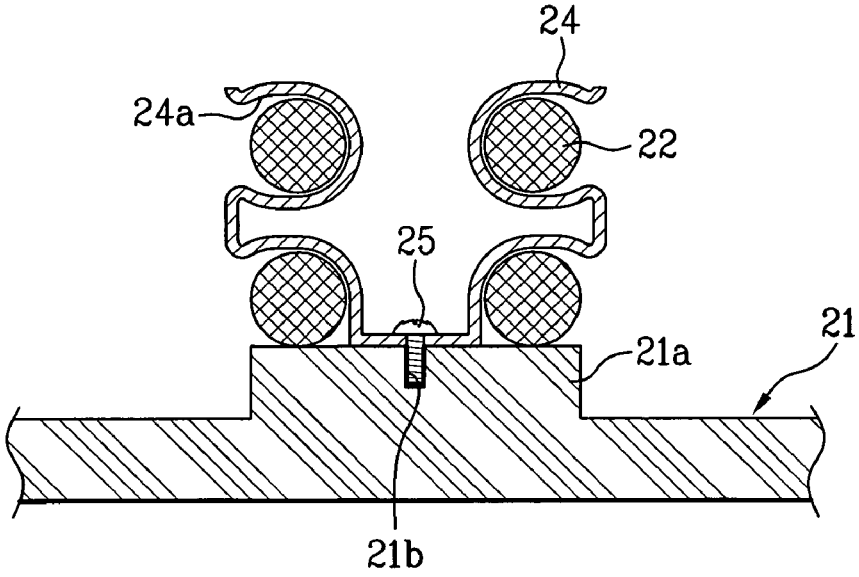
FIG. 3 is a cross-sectional view illustrating a structure of a heater fixing unit.

Referring to FIGS. 2 and 3, a heater 22 and a ventilation fan 23 are installed in an inside of the duct body 21 of the dry duct 20. The heater 22 is formed in a serpentine shape.

The duct body 21 is opened in its upper portion. Though not illustrated, a duct cover (not shown) is coupled to an upper portion of the duct body 21 so as to cover the opened upper portion.

The duct body 21 has at least two fixing parts 21*a* at its inner side and the heater 22 is supported by clamp members 24 screw-coupled to each fixing part 21*a*.

The fixing parts 21*a* may have a projected structure so that heat transfer to the duct body 21 may be minimized when the heater 22 emits heat. Further, the fixing parts 21 a may be formed in an approximate circular shape but not limited to the circular shape and can be modified to a variety of shapes.

Further, referring to FIG. 3, at least one fastening hole 21*b* for fastening the clamp member 24 using a screw 25 is formed on a central portion of the fixing part 21*a*. Thus, the clamp member 24 is fixed by the screw 25 with its central portion seated by the fixing part 21*a*.

In addition, the clamp member 24 is made of metal and has a structure such that a plurality of support grooves 24*a* which are confined when a predetermined portion of the heater 22 is elastically inserted are symmetrically formed in left/right.

In case two fixing parts 21*a* are formed on the duct body 21 as described above, the fixing parts 21*a* may be so arranged as to support the heater 22 in a diagonal direction. Such an arrangement can stably confine the heater with a small number of fixing parts 21*a*.

The number of the fixing parts 21*a* and a shape of the fixing parts 21*a* should be determined with consideration of a size and a bent shape of the heater 22.

Further, the fixing part 21*a* can be integrally formed with the duct body 21 and may also be manufactured separately from the duct body to be fixedly attached to the duct body by means of a screw, an adhesive, or welding.

Operation of the drum-type washing machine will be described.

The drum-type washing machine selectively or continuously performs a washing cycle, a rinsing cycle, a dewatering cycle, and a drying cycle.

If such cycles start, the motor unit 15 operates and a predetermined cycle is performed while the drum 14 rotates.

At this point, vibration generated by the motor unit 15 and the drum 14 is delivered to the tub 12. As the tub 12 vibrates, the vibration is also delivered to the dry duct 20 fixed to the tub 12.

As the dry duct 20 vibrates, the heater 22 also vibrates. At this point, since the heater 22 is elastically confined by two or more fixing parts 21*a* and the clamp members 24, transfer of the vibration of the tub to the heater is minimized and the heater can be stably fixed.

Figure 4:
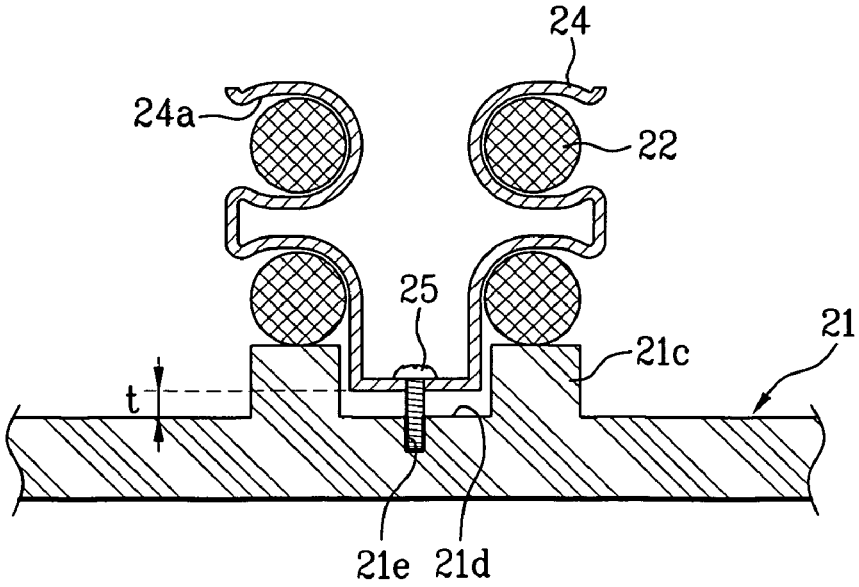
FIG. 4 is a cross-sectional view illustrating a heater fixing unit according to another embodiment of the present invention.

FIG. 4 is a view illustrating a heater fixing unit according to a second embodiment of the present invention. Referring to FIG. 4, fixing parts 21*c* are protruded from a lower surface of the duct body 21 and a fixing recess 21*d* is concaved in the central portion of the fixing parts 21*c*. A fastening hole 21*e* into which a screw 25 is fastened is formed in a central portion of the fixing recess 21*d*.

A clamp member 24 for fixedly supporting the heater 22 has the same structure as the clamp member of the above-described embodiment.

In the heater fixing unit according to the second embodiment, a heater 22 is inserted into and fixed at each support groove 24*a* of the clamp member 24 first. After that, a central portion of the clamp member 24 is fastened into the fixing recess 21*d* using the screw 25, so that the heater 22 is fixed to the duct body 21.

At this point, the central portion of the clamp member 24 fixed to the fixing recess 21*d* maintains a predetermined gap (t) with respect to a bottom of the fixing recess 21*d*. Accordingly, as the screw 25 is fastened even more, the clamp member 24 applies a more pressure on the heater 22 seated on the fixing parts 21*c*, whereby the heater 22 can be firmly supported on the fixing parts 21*c* by the clamp member 24.

Like the heater fixing unit of the first embodiment, the heater fixing unit of the second embodiment also has the fixing parts 21*c* and the clamp member 24 on at least two positions of the duct body 21. Further, the fixing parts 21*c* and the clamp member 24 may so installed as to support the heater 22 in a diagonal direction of the heater 22 on the duct body 21.

Further, though the fixing recess 21*d* is formed in the fixing parts 21*c* protruded from the duct body 21 according to the second embodiment, the fixing recess 21*d* may be also concaved from the duct body 21. Of course, in that case, a separate support (not shown) for supporting the heater 22 may be interposed beneath the heater 22 fixed to the clamp member 24 to prevent the heater 22 from touching the bottom of the duct body 21. The support may be formed integrally with the duct body or may be manufactured as a separate member to be attached to the duct body using a screw, an adhesive, or welding.

As is apparent from the foregoing, the dry duct of the drum-type washing machine has the following effects.

First, since the heater is supported by two or more fixing parts and clamp members in an inside of the dry duct, the heater can be stably fixed even in case vibration of the tub is directly delivered to the dry duct.

Second, since the heater is stably fixed in this manner, vibration of the heater which is generated as a fixing state of the clamp member that fixes the heater is loosened can be suppressed. Accordingly, a noise generation is minimized. Further, disorder of the heater due to vibration can also be prevented.

Third, since the clamp member elastically supports the heater, vibration delivered to the heater can be minimized even if vibration delivered to the tub becomes large.

Lastly, since the heater is supported in its diagonal direction, the heater can be more stably supported than a case where a central portion of the heater is supported.

It will be apparent to those skilled in the art that various modifications and variations can be made in the present invention. Thus, it is intended that the present invention covers the modifications and variations of this invention provided they come within the scope of the appended claims and their equivalents.

What is claimed is:

1. A heater fixing unit of a clothes dryer having a tub and a drum located within the tub, comprising:

a duct body whose one end communicates with an inside of the drum, the duct body fixed to the tub;

a heater installed inside of the duct body, for heating air inside of the duct body;

at least two or more heater fixing parts protruded from at least two or more positions on an inner surface of the duct body; and at least two or more elastic clamp members fixedly fastened to each fixing part of the duct body, for fixedly and elastically supporting the heater.

2. The heater fixing unit of claim 1, wherein the heater is formed in a serpentine shape and the fixing parts are formed in a diagonal direction of the heater such that each clamp member supports the diagonal direction of the heater.

3. The heater fixing unit of claim 1, wherein the clamp member integrally has a plurality of support grooves into which the heater is elastically inserted and supported.

4. The heater fixing unit of claim 1, wherein the clamp member has a central portion fixedly fastened to the fixing parts by means of a screw.

5. The heater fixing unit of claim 1, wherein a fixing recess is concaved between the fixing parts and a lower surface of the clamp member is inserted into an inside of the fixing recess such that clamp member is fixed thereto.

6. The heater fixing unit of claim 5, wherein the clamp member is fixedly fastened in an inside of the fixing recess by a screw.

7. The heater fixing unit of claim 6, wherein the lower surface of the clamp member and a bottom of the fixing recess have a predetermined gap (t) between them.

8. The heater fixing unit of claim 7, wherein the heater is pressed and supported by the clamp member with a lower portion of the heater fixed by the clamp member seated in the fixing part.

9. The heater fixing unit of claim 1, wherein the fixing part is integrally formed with the duct body.

10. The heater fixing unit of claim 1, wherein the fixing part is manufactured separately from the duct body are separate individual elements and fixedly attached to the duct body.

11. A heater fixing unit of a clothes dryer having a tub and a drum located within the tub, comprising:

a duct body whose one end communicates with an inside of the drum, the duct body fixed to the tub;

a heater installed inside of the duct body, for heating air inside of the duct body;

at least two or more fixing recesses concaved from at least two or more positions on an inner surface of the duct body; and at least two or more elastic clamp members fixedly fastened to each fixing recess of the duct body, for fixedly and elastically supporting the heater.

12. The heater fixing unit of claim 11, further comprising a support installed between a lower portion of the heater fixed by the clamp member and the duct body, for supporting the heater such that a predetermined interval can be maintained between the heater and the duct body.

13. The heater fixing unit of claim 11, wherein the heater is formed in a serpentine shape and fixing parts are formed on a diagonal direction of the heater such that each clamp member supports the diagonal direction of the heater.

14. The heater fixing unit of claim 12, wherein the heater is formed in a serpentine shape and fixing parts are formed on a diagonal direction of the heater such that each clamp member supports the diagonal direction of the heater.

15. The heater fixing unit of claim 12, wherein the clamp member is fixedly fastened in an inside of the fixing recess by a screw.

16. The heater fixing unit of claim 15, wherein a lower surface of the clamp member and a bottom of the fixing recess have a predetermined gap (t) between them.

17. The heater fixing unit of claim 12, wherein the support is integrally formed with the duct body.

18. A clothes dryer having a tub and a drum located within the tub comprising:

a duct body whose one end communicates with an inside of the drum, the duct body fixed to the tub;

a heater installed inside of the duct body, for heating air inside of the duct body;

at least two or more heater fixing parts protruded from at least two or more positions on an inner surface of the duct body; and at least two or more clamp members fixedly fastened to each fixing part of the duct body, for fixedly supporting the heater, wherein the clamp members elastically support the heater.

* * * * *